US007752708B2

(12) United States Patent
Gogel et al.

(10) Patent No.: US 7,752,708 B2
(45) Date of Patent: Jul. 13, 2010

(54) FLOOR CLEANING APPARATUS WITH FILTER CLEANING SYSTEM

(75) Inventors: Nathan A. Gogel, Hustonville, KY (US); Donald E. Proffitt, II, Richmond, KY (US); Alan T. Pullins, Richmond, KY (US); James Todd Crouch, Danville, KY (US); Michael L. Fry, Danville, KY (US); Eric J. Streciwilk, Perryville, KY (US); Michael S. Yacobi, Lexington, KY (US); Gary P. Charbonneau, Clifton Park, NY (US)

(73) Assignee: Panasonic Corporation of North America, Secaucus, NJ (US)

( * ) Notice: Subject to any disclaimer, the term of this patent is extended or adjusted under 35 U.S.C. 154(b) by 244 days.

(21) Appl. No.: 11/653,614

(22) Filed: Jan. 16, 2007

(65) Prior Publication Data

US 2007/0209151 A1 Sep. 13, 2007

Related U.S. Application Data

(60) Provisional application No. 60/780,211, filed on Mar. 8, 2006.

(51) Int. Cl.
*A47L 5/22* (2006.01)
*A47L 9/10* (2006.01)

(52) U.S. Cl. ..... 15/352; 55/285; 55/296

(58) Field of Classification Search ..... 15/352; 55/285, 295, 296; *A47L 5/22, 5/36, 9/10, A47L 9/20*

See application file for complete search history.

(56) References Cited

U.S. PATENT DOCUMENTS

| | | | | |
|---|---|---|---|---|
| 2,210,950 | A | 8/1940 | Replogle | |
| 2,507,042 | A | 5/1950 | Osborn | |
| 3,276,066 | A * | 10/1966 | Chiba | 15/352 |
| 4,124,916 | A | 11/1978 | Fromknecht | |
| 4,329,161 | A | 5/1982 | Osborn | |

(Continued)

FOREIGN PATENT DOCUMENTS

EP 1118303(A2) 7/2001

(Continued)

OTHER PUBLICATIONS

U.S. Appl. No. 11/188,155 filed Jul. 22, 2005, 32 pages.

(Continued)

*Primary Examiner*—David A Redding
(74) *Attorney, Agent, or Firm*—King & Schickli, PLLC

(57) ABSTRACT

A floor cleaning apparatus includes a housing and a dirt collection vessel carried on that housing. The dirt collection vessel includes a first air inlet, a second air inlet, a dirt collection chamber, a filter chamber and a clean air outlet. A filter is received in the filter chamber. A suction generator is carried on the housing. The floor cleaning apparatus also includes a flow control valve assembly. The flow control valve assembly is selectively displaceable between a first or home position wherein dirt and debris are captured in the dirt collection vessel and a second or filter cleaning position wherein clean air is drawn through at least a portion of the filter to clean the filter. An activator is provided for automatically displacing the flow control valve assembly between the first and second positions.

7 Claims, 8 Drawing Sheets

U.S. PATENT DOCUMENTS

| | | | | |
|---|---|---|---|---|
| 4,533,371 | A | 8/1985 | Nakamura | |
| 5,657,508 | A | 8/1997 | Herbreteau et al. | |
| 6,003,196 | A | 12/1999 | Wright et al. | |
| 6,026,540 | A | 2/2000 | Wright et al. | |
| 6,070,291 | A | 6/2000 | Bair et al. | |
| 6,260,234 | B1 | 7/2001 | Wright et al. | |
| 6,341,404 | B1 | 1/2002 | Salo et al. | |
| 6,353,963 | B1 | 3/2002 | Bair et al. | |
| 6,401,295 | B2 | 6/2002 | Bair et al. | |
| 6,428,589 | B1 | 8/2002 | Bair et al. | |
| 6,436,160 | B1 | 8/2002 | Stephens et al. | |
| 6,463,622 | B2 | 10/2002 | Wright et al. | |
| 6,588,054 | B2 | 7/2003 | Bair et al. | |
| 6,588,055 | B2 | 7/2003 | Bair et al. | |
| 6,591,446 | B2 | 7/2003 | Bair et al. | |
| 6,735,815 | B2 | 5/2004 | Bair et al. | |
| 6,735,817 | B2 | 5/2004 | Bair et al. | |
| 6,745,432 | B2 | 6/2004 | Wright et al. | |
| 6,818,036 | B1 | 11/2004 | Seaman | |
| 6,830,599 | B1 | 12/2004 | McCutchen | |
| 6,848,146 | B2 | 2/2005 | Wright et al. | |
| 6,989,039 | B2 | 1/2006 | Vujik | |
| 6,994,740 | B2 | 2/2006 | Gammack et al. | |
| 7,047,593 | B2 | 5/2006 | Kitamura | |
| 7,222,392 | B2 * | 5/2007 | McCormick et al. | 15/353 |
| 7,287,301 | B2 | 10/2007 | Marshall | |
| 7,351,269 | B2 * | 4/2008 | Yau | 55/297 |
| 7,673,369 | B2 | 3/2010 | Gogel et al. | |
| 2004/0163202 | A1 | 8/2004 | Yoshimi et al. | |
| 2004/1632002 | | 8/2004 | Yoshima et al. | |
| 2005/0011036 | A1 | 1/2005 | McCutchen | |
| 2006/0010641 | A1 | 1/2006 | Nam et al. | |
| 2007/0017064 | A1 | 1/2007 | Gogel et al. | |

FOREIGN PATENT DOCUMENTS

| | | | |
|---|---|---|---|
| EP | 1 504 710 | A2 | 2/2005 |
| GB | 2 280 388 | A | 2/1995 |
| GB | 2 428 559 | | 2/2007 |
| JP | 48-44735 | | 12/1973 |
| JP | 49-110964 | | 9/1974 |
| JP | 354084365 | * | 7/1979 |
| JP | 354084365(A) | | 7/1979 |
| JP | 54116778(A) | | 9/1979 |
| JP | 2159233(A) | | 6/1990 |
| JP | 2004358031(A) | | 12/2004 |
| JP | 2004358135(A) | | 12/2004 |
| WO | WO 02/28260 | A1 | 4/2002 |
| WO | WO 2005/053497 | A1 | 6/2005 |

OTHER PUBLICATIONS

U.S. Appl. No. 11/541,989 filed Oct. 2, 2006, 26 pages
U.S. Appl. No. 11/633,902 filed Dec. 5, 2006, 2007, 27 pages.
USPTO Office Action dated Oct. 3, 2008 for U.S. Appl. No. 11/633,902, 7 pgs.
USPTO Office Action dated Oct. 21, 2008 for U.S. Appl. No. 11/188,155, 5 pgs.
USPTO Office Action dated Jan. 29, 2009 for U.S. Appl. No. 11/541,989, 6 pgs.
USPTO Office Action dated Feb. 4, 2009 for U.S. Appl. No. 11/188,155, 8 pgs.
USPTO Office Action dated Apr. 16, 2009 for U.S. Appl. No. 11/633,902, 7 pgs.
USPTO Office Action dated Jul. 17, 2009 for U.S. Appl. No. 11/541,989, 7 pgs.
USPTO Office Action dated Jul. 21, 2009 for U.S. Appl. No. 11/188,155, 8 pgs.
USPTO Notice of Allowance dated Oct. 5, 2009 for U.S. Appl. No. 11/188,155, 4 pgs.
USPTO Office Action dated Oct. 28, 2009 for U.S. Appl. No. 11/633,902, 7 pgs.
USPTO Notice of Allowance dated Dec. 15, 2009 for U.S. Appl. No. 11/188,155, 7 pgs.
USPTO Notice of Allowance dated Jan. 13, 2010 for U.S. Appl. No. 11/633,902, 6 pgs.
USPTO Notice of Allowance dated Feb. 1, 2010 for U.S. Appl. No. 11/541,989, 8 pgs.
USPTO Office Action dated Oct. 8, 2008 for U.S. Appl. No. 11/541,989, 8 pgs.

* cited by examiner

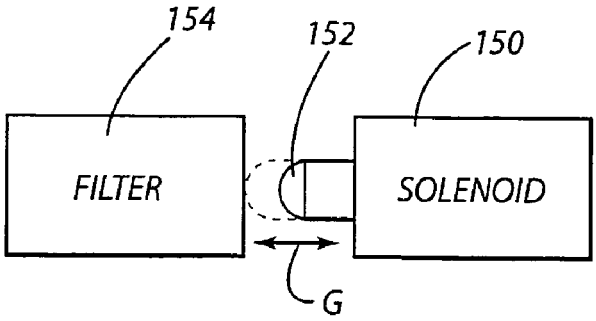
Fig. 8a
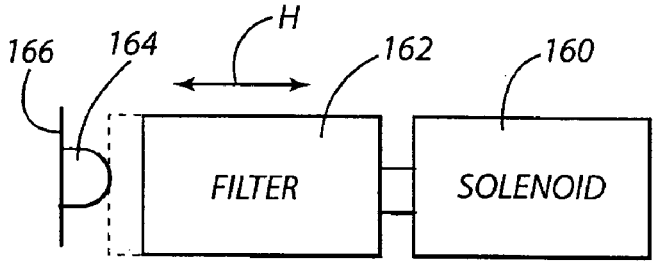
Fig. 8b
Fig. 8c
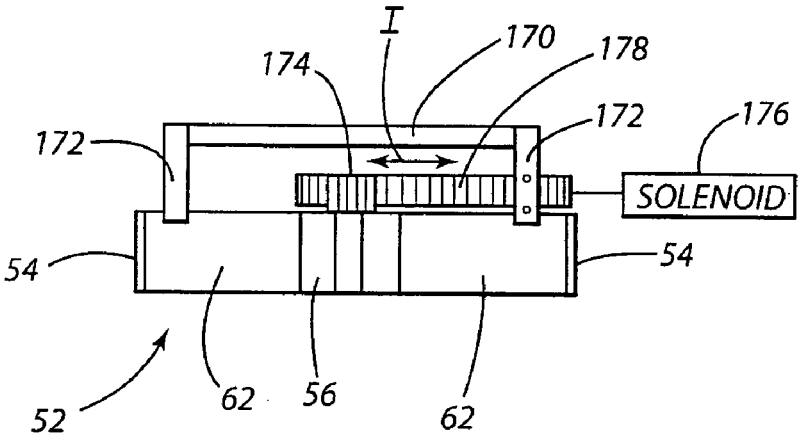
Fig. 8d
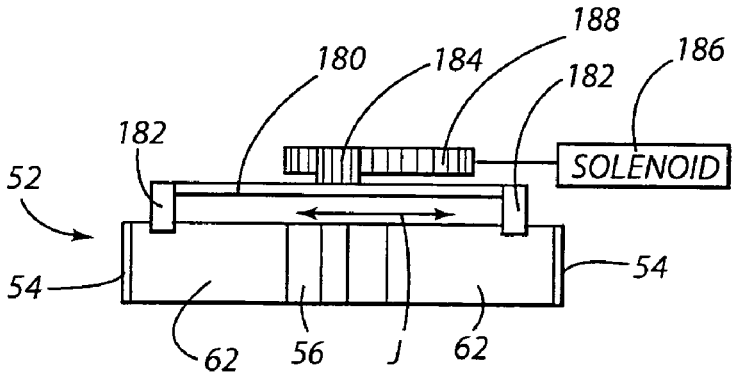

FLOOR CLEANING APPARATUS WITH FILTER CLEANING SYSTEM

This application claims the benefit of U.S. Provisional Patent Application Ser. No. 60/780,211 filed on 8 Mar. 2006.

TECHNICAL FIELD

The present invention relates generally to the floor care equipment field and, more particularly, to a vacuum cleaner, extractor or the like equipped with a solenoid driven mechanism for vibrating dirt and debris from the filter including, particularly, fine dirt particles from the pores of the filter in order to enhance filter cleaning efficiency and extend filter service life.

BACKGROUND OF THE INVENTION

A vacuum cleaner is an electromechanical appliance utilized to effect the dry removal of dust, dirt and other small debris from carpets, rugs, fabrics or other surfaces in domestic, commercial and industrial environments. In order to achieve the desired dirt and dust removal, most vacuum cleaners incorporate a rotary agitator. The rotary agitator is provided to beat dirt and debris from the nap of the carpet or rug while a pressure drop or vacuum is used to force air entrained with this dirt and debris into the nozzle of the vacuum cleaner. The particulate laden air is then drawn into a dirt collection vessel. The air is then drawn through a filter before being directed through the motor of the suction generator to provide cooling. Finally, the air is filtered to remove any fine particles of carbon from the brushes of that motor or other dirt that might remain in the airstream before being exhausted back into the environment.

Often the dirt collection vessel is designed to produce cyclonic airflow by providing that vessel with a dirt chamber having a cylindrical sidewall and a tangentially directed air inlet. This arrangement forces the air to swirl around the dirt collection chamber in the manner of a cyclone. The centrifugal force that is produced causes dirt and debris to move toward and against the cylindrical sidewall of the chamber while relatively clean air may be drawn off from the center of the chamber through the filter toward the suction generator.

Under most operating conditions most or all of the dirt and debris is removed from the airstream by the cyclonic airflow. At times, however, some dirt and debris remains entrapped within the airstream. Typically, that dirt and debris is relatively fine dirt particles of light weight which are not as susceptible to the centrifugal separation force produced by the cyclonic airflow. Over time such fine particles may become entrapped and fill the pores of the filter media thereby restricting airflow and reducing the cleaning efficiency of the vacuum cleaner. Eventually the cleaning efficiency of the vacuum cleaner becomes so impaired it is necessary for the operator to either clean or change the filter in order to achieve the desired level of cleaning.

The present invention relates to a vacuum cleaner, extractor or the like equipped with a more efficient and effective filter cleaning mechanism. Advantageously, the present invention allows one to quickly and conveniently clean dirt and debris from a filter including particularly fine particles from the pores of the filter in situ. As a result each filter has a longer service life and the apparatus may be operated at a higher cleaning efficiency over the entire length of that extended service life.

SUMMARY OF THE INVENTION

In accordance with the purposes of the present invention as described herein, a floor cleaning apparatus is provided. The floor cleaning apparatus comprises a housing carrying a suction generator and a dirt collection vessel. A filter is carried in the dirt collection vessel and a clicker engages the filter. Further, a solenoid is provided for driving the clicker and cleaning the filter. In one possible embodiment the clicker is a rotary clicker. The rotary clicker includes a pinion, a body and at least one resilient lug. A rack is attached to the solenoid and engages the pinion. Further, the housing includes a nozzle assembly and a canister assembly. In one possible embodiment the nozzle assembly and canister assembly are pivotably connected together.

In the following description there is shown and described several preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification, illustrate several aspects of the present invention, and together with the description serve to explain certain principles of the invention. In the drawings:

FIGS. 8*a*-8*d* are schematical illustrations of solenoid driven clicker arrangements for cleaning dirt and debris from a filter.

Reference will now be made in detail to the present preferred embodiments of the invention, examples of which are illustrated in the accompanying drawing figures.

DETAILED DESCRIPTION OF THE INVENTION

Figure 1:
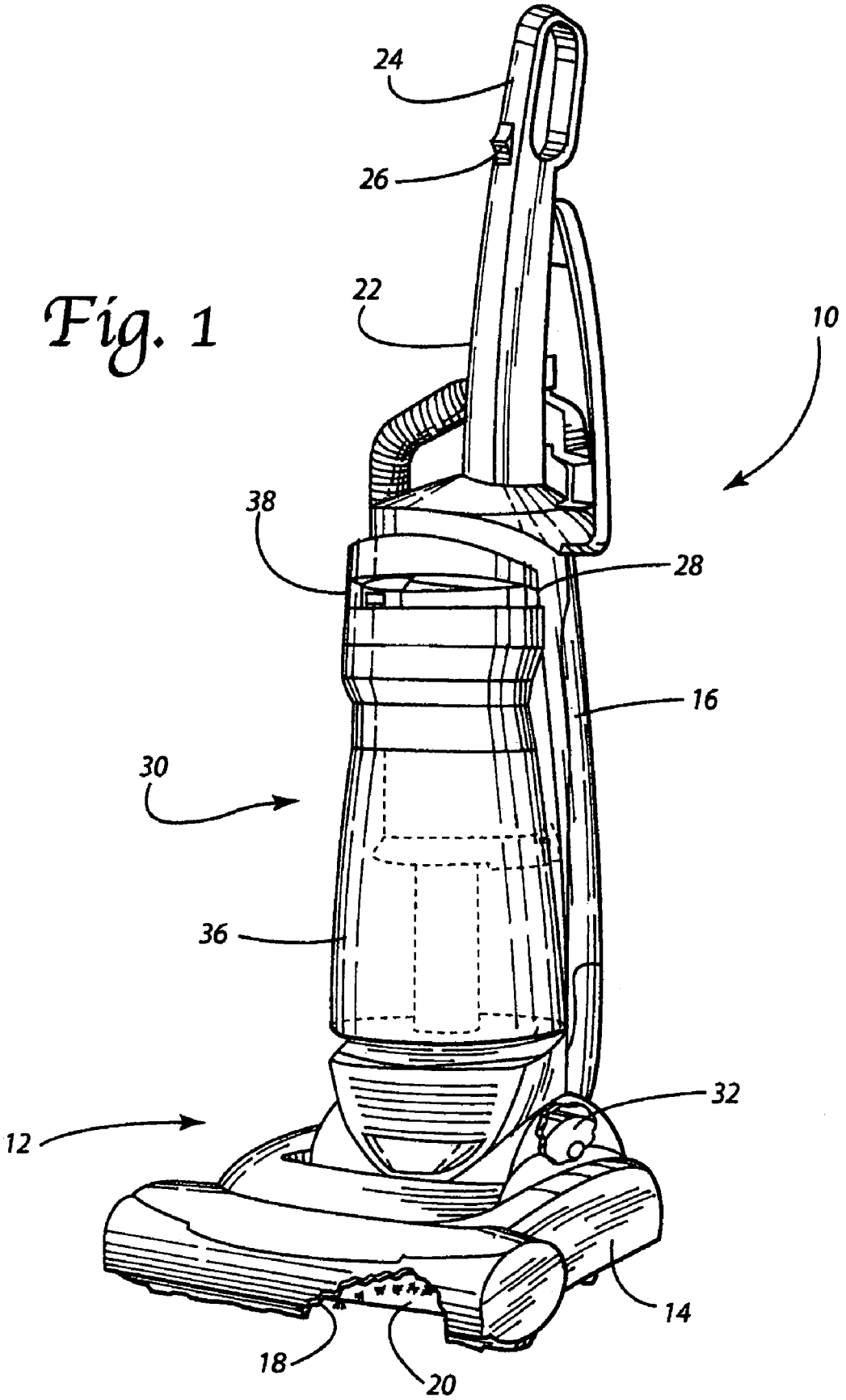
FIG. 1 is a perspective, partially broken-away view of the floor cleaning apparatus of the present invention.

Reference is now made to FIG. 1 which illustrates the floor cleaning apparatus 10 of the present invention. In the illustrated embodiment, the floor cleaning apparatus 10 comprises an upright vacuum cleaner. It should be appreciated, however, that the apparatus 10 may just as easily be a canister vacuum cleaner, a handheld vacuum cleaner or even an extractor.

As illustrated, the apparatus 10 includes a housing 12 including both a nozzle assembly 14 and a canister assembly 16. The nozzle assembly 14 includes a suction inlet 18 through which air entrained with dirt and debris is drawn into the vacuum cleaner 10. A rotary agitator 20 is mounted to the nozzle assembly 14 and extends across the suction inlet 18.

The canister assembly 16 includes a handle 22 having a handgrip 24. An actuator switch 26 for turning the vacuum cleaner on and off is provided adjacent the handgrip. In addition the canister assembly 16 includes a cavity or receiver 28 for receiving and holding a dirt collection vessel 30. A suction generator 32 is mounted in a compartment in the canister assembly 16. During normal operation, the rotary agitator 20 beats dirt and debris from the nap of the rug or carpet being cleaned. The suction generator 32 draws air entrained with that dirt and debris through the suction inlet 18 into the dirt collection vessel 30. The dirt and debris is trapped in the dirt collection vessel 30 and the now relatively clean air passes through and over the motor of the suction generator 32 to provide cooling before being exhausted through an exhaust port (not shown) back into the environment.

Figure 2:
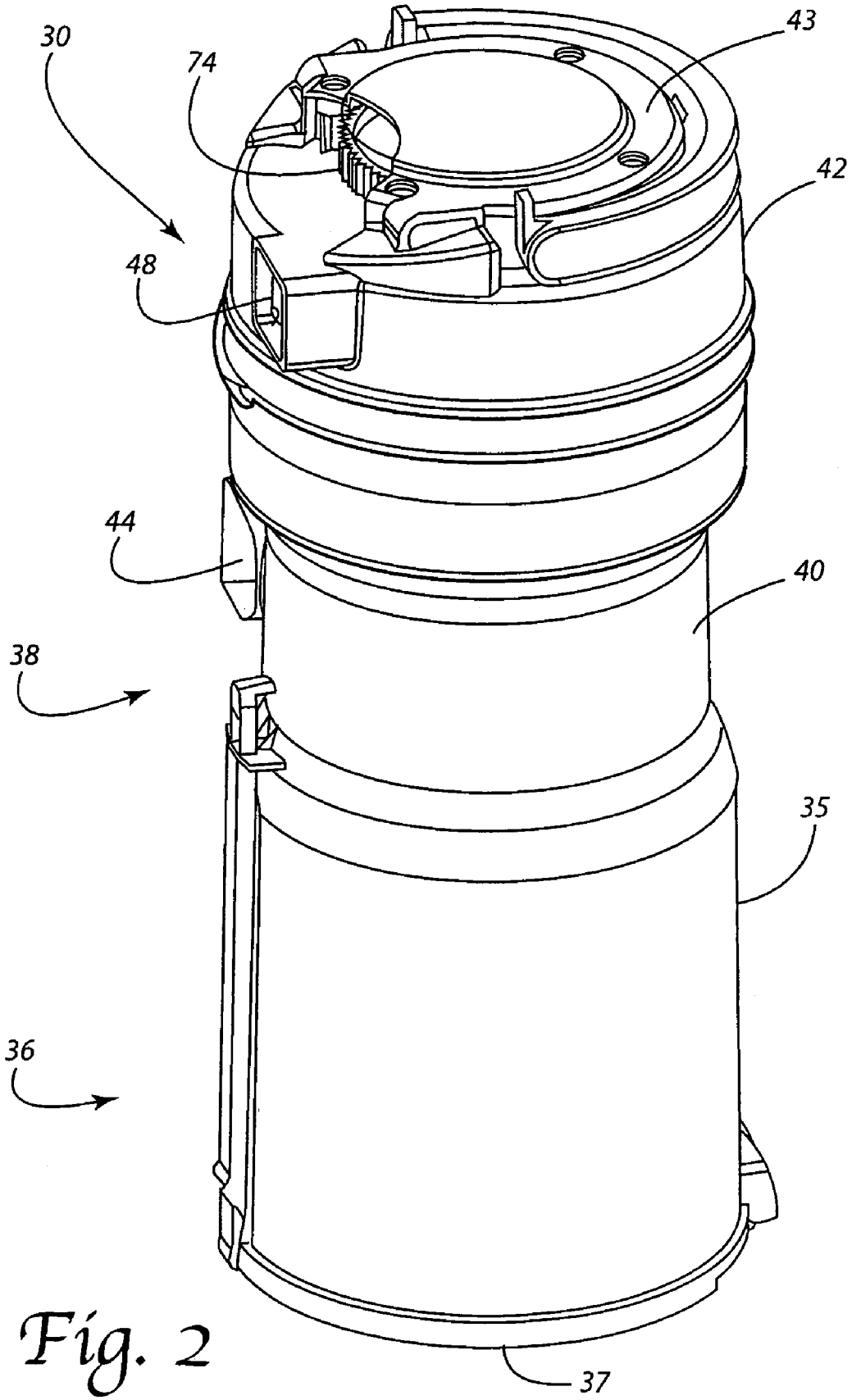
FIG. 2 is a detailed perspective view of the assembled dirt collection vessel.
Figure 3:
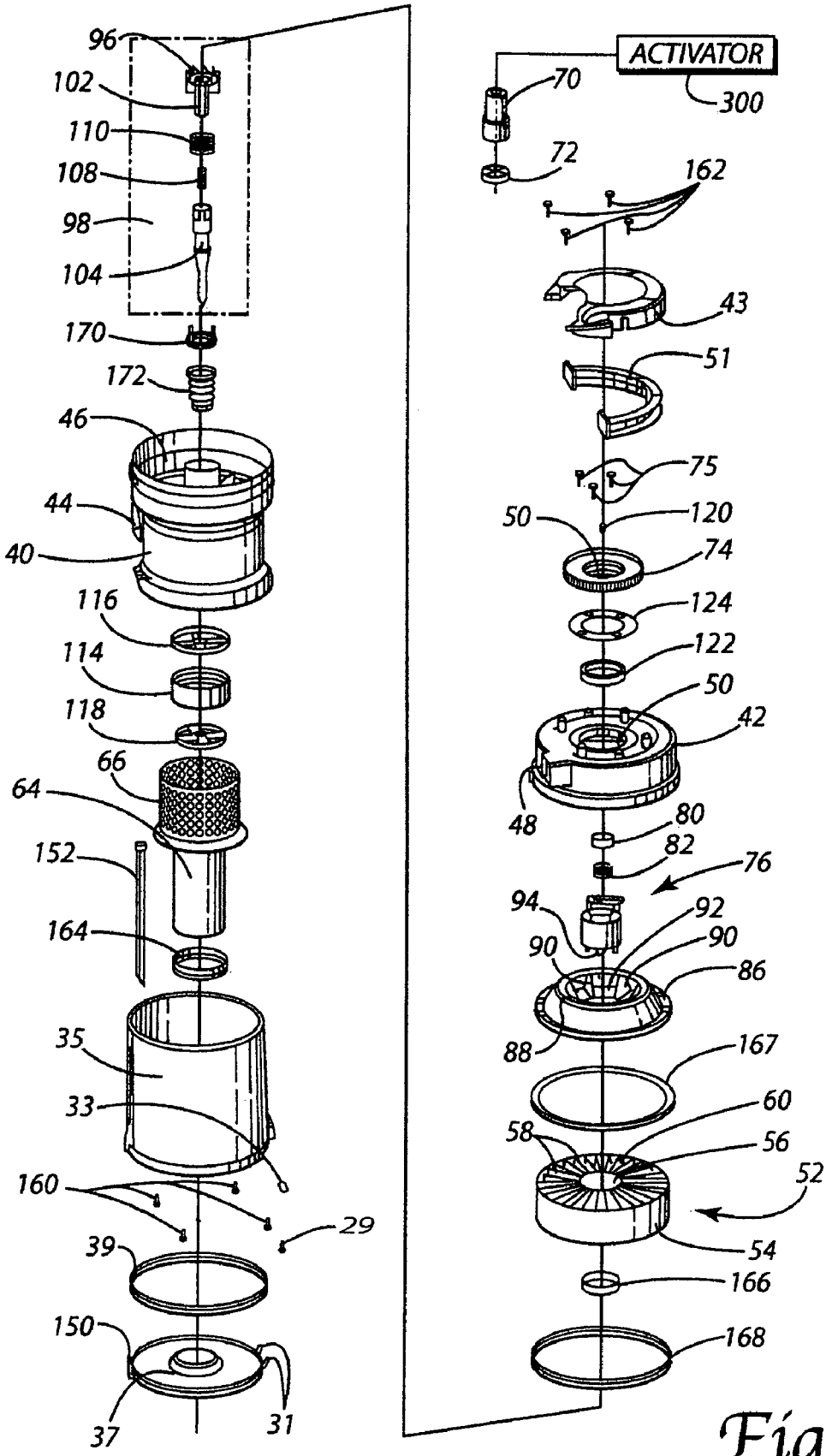
FIG. 3 is an exploded perspective view of the dirt collection vessel, filter and flow control valve assembly of the present invention.

As best illustrated in FIGS. 2 and 3, the dirt collection vessel 30 comprises a dirt cup section 36 and a lid section 38. The dirt cup section 36 comprises a sidewall 35, a bottom wall 37 and a packing ring 39. In the illustrated embodiment, the bottom wall 37 is a "dump door" connected by a hinge 31 to the side wall 35. A bracket 33 and fastener 29 complete the hinged connection. A latch 150 secures the bottom wall 37 in the closed position. A sliding latch release 152 is displaced downwardly to release the latch 150 and open the bottom wall 37 in order to dump dirt and debris from the dirt collection vessel in a manner described in greater detail in co-pending U.S. patent application Ser. No. 11/104,711 filed 13 Apr. 2005.

The lid section 38 comprises a first element 40, a second element 42 and a third element 43. The first element 40 includes the first or dirty air inlet 44 and a filter chamber or cavity 46. The second element 42 includes a clean air outlet 48. The third element 43 receives a pivoting handle 51 for conveniently carrying the dirt collection vessel 30. The first element 40 is connected to the side wall 35 by the screws 160. The third element 43 is connected to the second element 42 by the screws 162.

Figure 6:
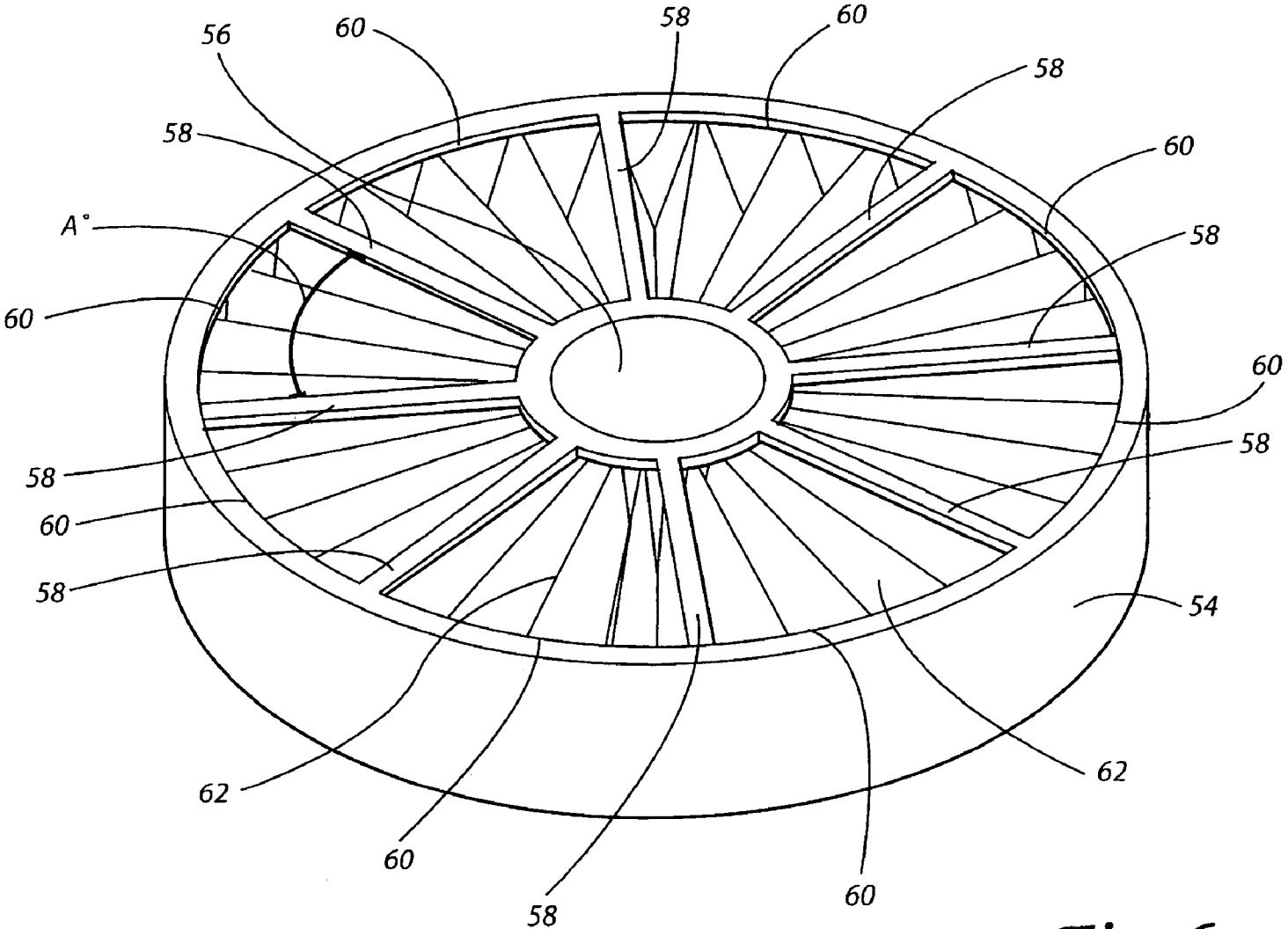
FIG. 6 is a detailed top perspective view of the filter assembly.

A filter, generally designated by reference numeral 52, is received in the filter cavity 46 of the first element 40. The filter 52 includes a sidewall 54, a hub 56 and multiple partitions 58 extending between the hub and the sidewall (see also FIG. 6). The partitions 58 serve to divide the filter 52 into multiple sections 60. A filter media 62, of a type well known in the art, extends between the sidewall 54, hub 56 and partitions 58 defining each section 60. Gaskets 166 and 168 provide a seal between the hub 56 and the side wall 54 of the filter 52 and the supporting lid element 40.

A prefilter 66 and an inner support 64 extend downwardly in the dirt cup section 36 from the first element 40 to the bottom wall 37. A gasket 164 provides an airtight seal between the support 64 and the bottom wall 37. The prefilter 66 includes a series of intake apertures 68 that allow airflow in a manner that will be described in greater detail below.

Figure 4:
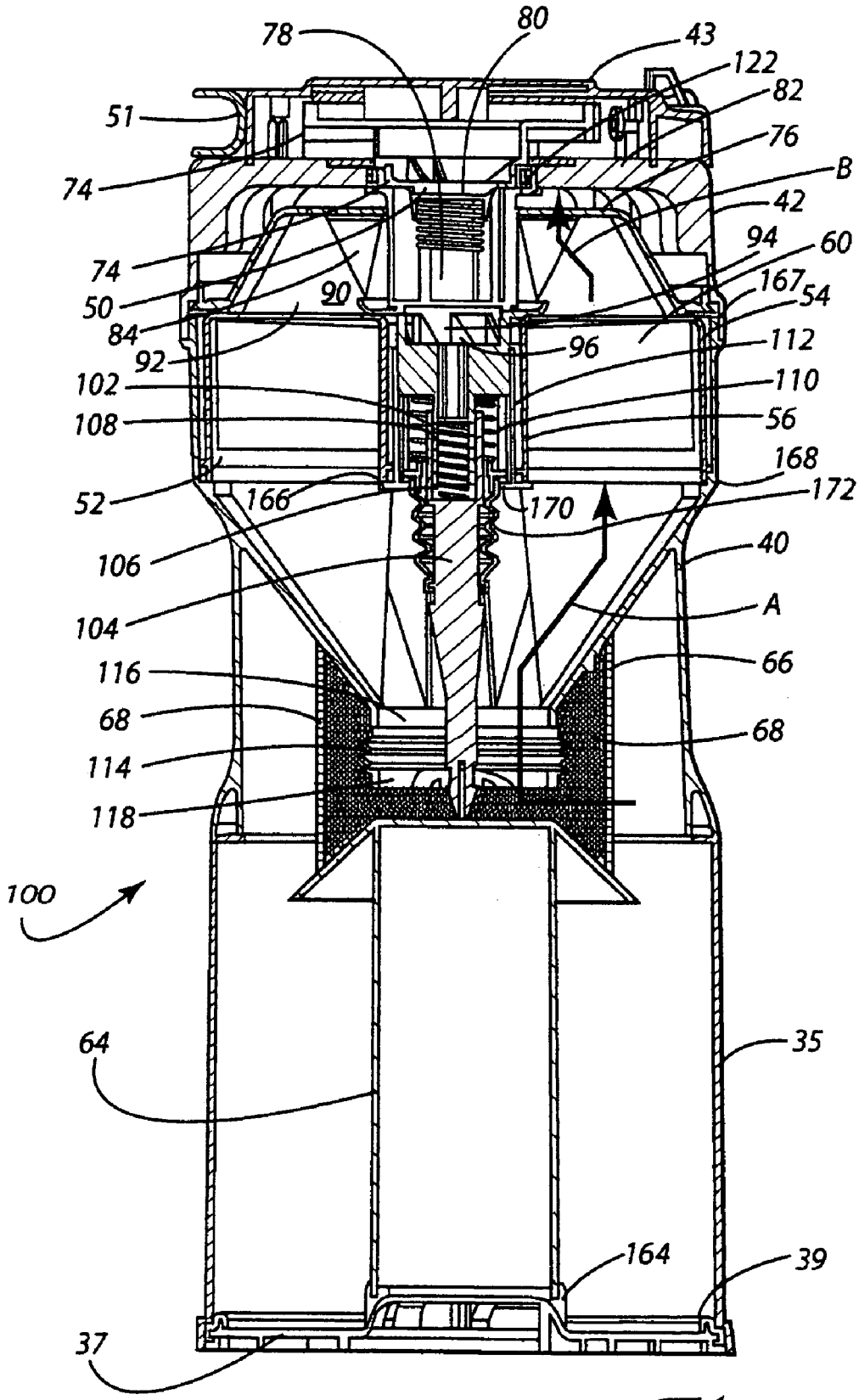
FIG. 4 is a cross-sectional view of the dirt collection vessel, filter and flow control valve assembly in the first position allowing for normal vacuum cleaner operation.
Figure 5:
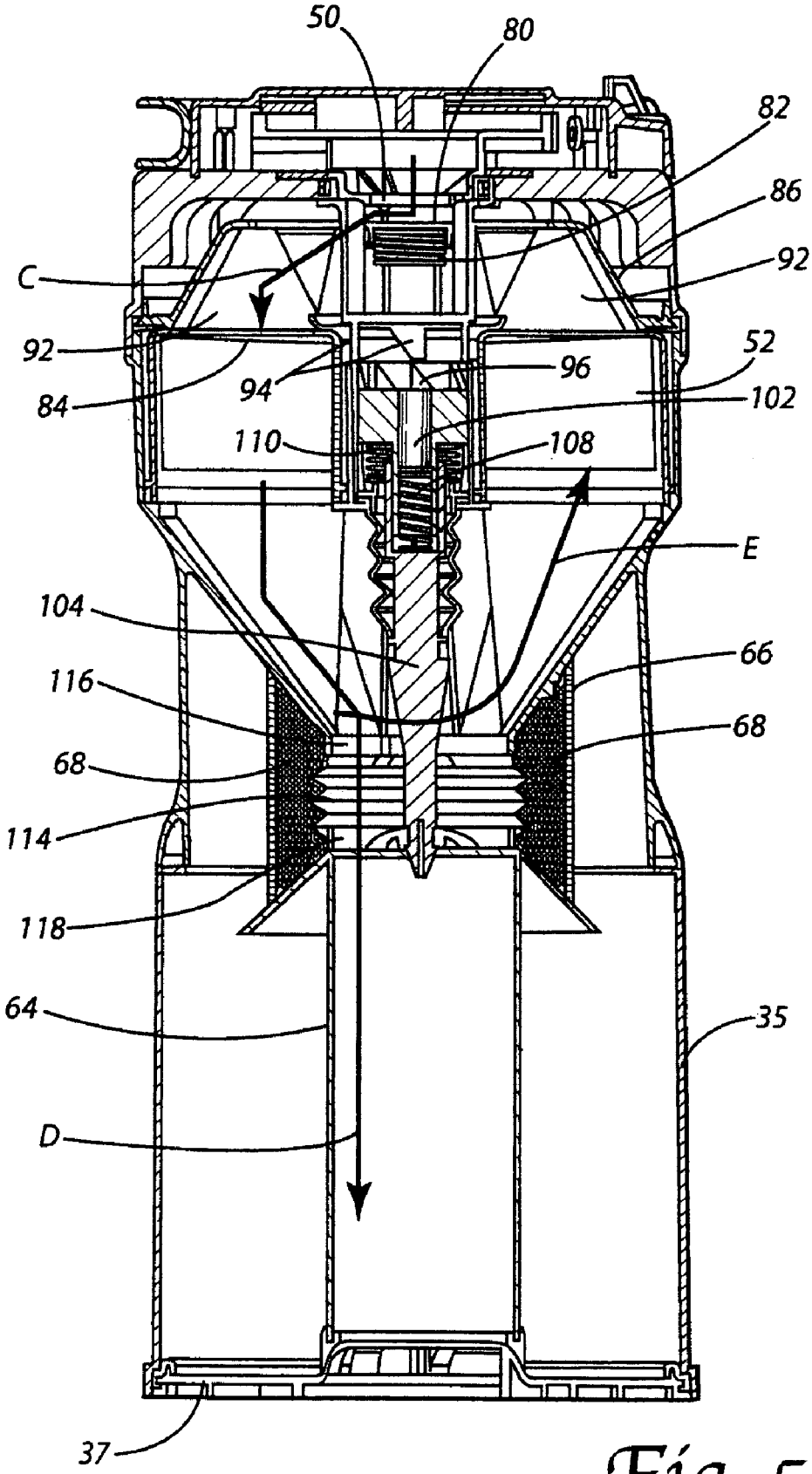
FIG. 5 is a cross-sectional view similar to FIG. 4 but illustrating the flow control valve assembly in the second position allowing cleaning of a section of the filter.

In the illustrated embodiment, the dirt collection vessel 30 is designed to produce cyclonic airflow and thereby use centrifugal force to improve the efficiency with which dirt and debris are removed from the airstream. More specifically, as clearly illustrated in FIG. 3, the dirt cup section 36, the lid section 38, the inner support 64, the prefilter 66 and the filter 52 are all substantially cylindrical in shape. As illustrated in FIGS. 4 and 5, the inner support 64 and prefilter 66 are concentrically received in the sidewall 35 of the dirt cup section 36. The filter 52 is concentrically received in the filter cavity 46 of the first element 40 of the lid section 38. The dirty air inlet 44 is tangentially directed into the annular space formed between (a) the first element 40 and sidewall 35 on the outside and (b) the inner support 64 and prefilter 66 on the inside.

The airstream flows around the annular space or dirt collection chamber in a circular or vortex pattern generating centrifugal force that causes dirt and debris in the airstream to move outwardly toward the sidewall 35 thereby causing the dirt and debris to collect in the dirt cup section 36. Simultaneously, the relatively clean air is drawn through the intake apertures 68 provided in the prefilter 66 along the inner wall of the annular space where it is then directed upwardly through the filter 52. Specifically, the air passes through the filter media 62 where any fine dirt and debris remaining in the airstream is stopped while clean air passes through the media on through the clean air outlet 48 to the suction generator 32. The direction of airflow during normal vacuum cleaner operation when the flow control valve assembly is in the home position is illustrated by action arrows in FIG. 4.

The flow control valve assembly of the present invention will now be described in detail. The flow control valve assembly includes an actuator such as a drive motor 70 that is connected to a first drive gear 72. The first drive gear 72 meshes with a second drive gear 74 carried in the lid 38. The second drive gear 74 is connected to a rotary air guide 76 by the screws 75. The air guide 76 has a concavity 78 that holds a clean air inlet valve comprising a valve body 80 and biasing spring 82. When in the home or normal operating position illustrated in FIG. 4, the valve body 80 engages and closes the second clean air inlet 50 provided in the element 42 and further defined by the central aperture in the second drive gear 74. As further illustrated in the drawing figures the air guide 76 includes an air guide passage 84 that defines an arc of A°.

The flow control valve assembly also includes a static air guide 86 that is held in the lid 38 overlying the filter 52. A seal 167 is provided between the air guide and the filter 52. The static air guide 86 includes a central aperture 88 and a series of radially arrayed partitions 90 defining a series of air pathways also having an arc of A°. As noted above, the filter 52 includes partitions 58 that divide the filter into equal sections 60 each having an arc of A°. It should be appreciated that the partitions 90 in the static air guide 86 are aligned with the partitions 58 in the filter 52. Accordingly, the air pathways or air guide sections 92 in the static air guide 86 are each aligned with a single section 60 of the filter 52.

In the illustrated embodiment, the filter 52 includes eight partitions 58 dividing the filter 52 into eight equal sections 60, each spanning a 45° arc. Similarly, the static air guide 86 includes eight partitions 90 dividing the guide into eight air pathways 92 each spanning an arc of 45°. Further the air guide passage 84 in the air guide 76 also spans an arc of 45°. As will be described in greater detail below the air guide 76 is precisely rotated to bring the air guide passage 84 in perfect alignment with a single air pathway 92 of the static air guide 86 and thus a single section 60 of the filter 52 during each movement of the filter cleaning cycle.

As further illustrated, the air guide 76 includes a first cam 94 projecting from the bottom wall thereof. The cam 94 includes eight cam profiles, one for each section 60 of the filter 52. The cam 94 engages a cam follower 96 (also with eight matching profiles) that is connected by means of a telescoping shaft to a flow control valve 100. More specifically, the telescoping shaft 98 comprises a first section 102 connected to the cam follower 96 and a second section 104 having a bore 106 that telescopingly receives the first section 102. A compression spring 108 received in the bore 106 engages the first section 102 of the shaft and biases the telescoping shaft 98 into an extended position. A second compression spring 110 is received in the hub 112 of the element 40. This compression spring 110 engages the bottom of the cam follower 96 and biases the cam follower 96 into engagement with the cam 94. A cap seal 170 and expander 172 seal around the shaft 98 and the element 40 to prevent any passage of air.

The flow control valve 100 comprises a flexible tubular diaphragm 114 supported at a first or upper end by a first open air guide 116 and a second or lower end by a second open air guide 118. The air guide 116 is secured to the element 40 and is static. In contrast, the second open air guide 118 is fastened to the distal end of the second section 104 of the telescoping shaft 98.

During normal vacuum cleaner operation when the flow control valve assembly is in the home position, the rotary agitator 20 functions to beat dirt and debris from the nap of an underlying carpet being cleaned. That dirt and debris is then drawn by the suction generator 32 through the inlet 44 into the dirt collection vessel 30. As the airstream flows in cyclonic fashion around the side wall 35, dirt and debris are collected in the dirt collection vessel 30. The relatively clean air is then drawn through the apertures 68 in the prefilter 66 (see action arrow A in FIG. 4) up through the filter 52. The filter media 62 allows the passage of clean air but prevents the passage of any relatively fine dust particles that might remain in the airstream. The now clean air then passes upwardly through the static air guide 86 (note action arrow B) and then passes through the air outlet 48. The air then travels through a conduit to the suction generator 32. From there the clean air passes over the motor of the suction generator 32 to provide cooling before being exhausted to the environment through a final filter and exhaust port (not shown) back into the environment.

As the vacuum cleaner 10 operates, the fine dirt particles not removed from the airstream by the cyclonic action in the dirt cup section 36 are stripped from the airstream and trapped by the filter media 62 of the filter 52. Over time, these fine particles begin to close off the pores in the filter media 62 thereby restricting airflow. This not only causes the motor of the suction generator 32 to run hotter and at a lower efficiency, it also reduces airflow thereby adversely affecting the cleaning efficiency of the vacuum cleaner 10. Consequently, the airflow may become so restricted as to prevent the vacuum cleaner from cleaning properly. Before this occurs it is then necessary to either clean or replace the filter 52.

The present invention allows the filter 52 to be cleaned in situ in a very convenient and efficient manner before any substantial loss of cleaning power or efficiency occurs. Specifically, the motor 70 is activated to rotate the air guide 76 through an arc of 45° by means of the meshing gears 72, 74. Precise rotation may be provided by a stepper motor or a permanent magnet direct current motor in combination with a sensor and sensor target such as a magnet 120 fastened to or held in a cavity on the drive gear 74. An annular bearing 122 and cooperating bearing plate 124 ensure free rotation of the drive gear 74. As the rotation is completed, the air guide passage 84 in the air guide 76 is aligned with one of the air pathways 92 in the static air guide 86 and, accordingly, one of the sections 60 of the filter 52. The rotation of the drive gear 74 simultaneously causes the cam 94 on the bottom of the air guide 76 to rotate from the position shown in the FIG. 4 to the position shown in FIG. 5.

As this occurs, the cam follower 96 follows the cam 94 causing the telescoping shaft 98 to be displaced downwardly. This in turn causes the second open air guide 118 of the flow control valve 100 to engage the top of the support 64. As this occurs the diaphragm 114 is expanded and the air pathway for normal operation illustrated by action arrow A in FIG. 4 is interrupted (compare FIG. 5 to FIG. 4). Thus, the first flow control valve 80 and second flow control valve 100 are placed in the filter cleaning position. The telescoping shaft 98 accommodates any discrepancy that may exist in the height of the cam 94 and the distance the second open air guide 118 is moved to engage the top of the support 64.

When the valve 100 closes the normal airflow pathway, no air may be drawn by the suction generator through the prefilter 66 or the suction inlet 18. As the negative pressure builds, the biasing force of the spring 82 is overcome and the valve body 80 is displaced to open the clean air inlet 50 in the element 42 and the drive gear 74. As a consequence, clean air is drawn through the inlet 50 past the valve body 80. That clean air then passes through the air guide passage 84 in the air guide 76 and the aligned air pathway 92 in the static air guide 86 (see action arrow C in FIG. 5). The clean air is then drawn through a single section 60 of the filter 52 in a direction reverse to normal flow so as to remove fine dust particles from the pores of the filter media 62. As a result of a pressure drop, those fine dust particles settle in the bottom of the support 64 (note action arrow D) while the airstream travels back through the other sections 62 of the filter 52 not aligned with the passage 84 of the air guide 76 (note action arrow E). The airstream then travels back through the air pathways 92 of the static air guide 86 (i.e. those not aligned with the air guide passage 84) before passing out of the dirt collection vessel 30 through the outlet 48. The airstream is then drawn through the suction generator 32 before being exhausted back into the environment.

During a cleaning cycle, the sections 60 of the filter 52 are sequentially cleaned in the manner described above as the air guide 76 is rotated into alignment with each air pathway 92 and each filter section 60. The cleaning cycle may last, for example, from about one to about 30 seconds and more typically from about 3 to about 15 seconds. After rotating the air guide 76 precisely through 360°, the drive motor 70 stops and the flow control valve 100 is opened as illustrated in FIG. 4. When this occurs, airflow is restored to the suction inlet 18 and the spring 82 biases the valve body 80 so as to close the clean air inlet 50 and restore airflow for normal vacuum cleaner operation (i.e. the first flow control valve 80 and the second flow control valve 100 are returned to the home position).

The motor 70 is activated by means of an activator 300 as schematically illustrated in FIG. 3. The activator 300 may assume a number of forms. In one possible embodiment, the activator 300 is a timer that times the operation of the suction generator 32 of the vacuum cleaner 10. After the suction generator 32 is operated for a predetermined period of time, such as, for example 15 minutes, the timer 300 activates the motor 70 to initiate the filter cleaning cycle.

In another possible embodiment, the activator 300 is a position sensor. In this embodiment, the position sensor 300 detects the position of the handle 22. Upon detecting the return of the handle 22 into the upright, storage position from the lowered, use position, the position sensor activates the motor 70 to initiate the filter cleaning cycle.

In yet another embodiment, a timer is added to the position sensor so that the activator 300 only functions to initiate the cleaning cycle when the handle 22 is returned to the upright position after a predetermined time of operation has lapsed since the last filter cleaning.

In still another embodiment the activator 300 is a performance sensor. The performance sensor 300 may, for example, be an air pressure sensor for sensing air pressure between the dirt collection vessel 30 and the suction generator 32 or a dirt volume sensor for detecting the level of dirt in the dirt cup. Upon reaching a predetermined pressure or level of dirt, such an activator 300 functions to activate the motor 70 and initiate the cleaning cycle.

In yet another alternative embodiment, the activator 300 is a switch. The switch 300 may function to initiate the filter cleaning cycle when the vacuum cleaner 10 is first switched on or when the vacuum cleaner is switched off.

Still further, the vacuum cleaner 10 may include a manual activator switch 300. The manual switch 300 may be engaged by the user at any desired time in order to initiate the cleaning cycle. Obviously, a manual switch of this nature may be provided on the vacuum cleaner in addition to any of the other activators previously discussed if desired to allow the user to override the automatic system to initiate the cleaning cycle.

Figure 7:
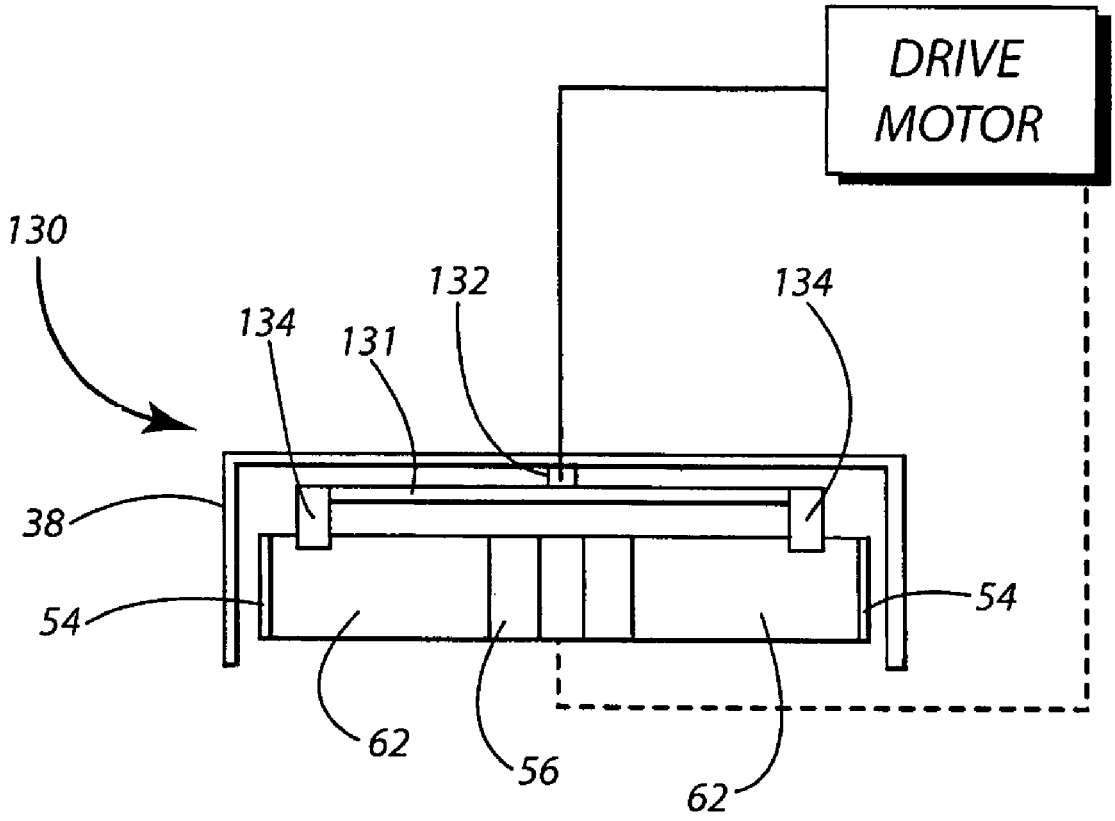
FIG. 7 is a schematical illustration of an additional filter cleaning feature that may be utilized to clean dirt and debris from the filter in situ in the dirt collection vessel.

Reference is now made to FIG. 7 schematically illustrating an optional additional feature of the present invention that may be provided to further enhance the cleaning of the filter 52. A clicker 130 may be provided. In the illustrated embodiment the clicker 130 includes an elongated mounting arm 131 that is held on a stub shaft 132 secured to the lid section 38. A resilient flap 134 is provided at each end of the arm 131. As illustrated the tips of the flaps 134 engage the media 62 of the filter 52 between the sidewall 54 and the hub 56. A drive motor 136 is provided. As illustrated in full line in FIG. 7, the drive motor may be connected to the clicker 130 and activated to rotate the clicker with respect to the lid section 38 and the filter 52. As the clicker 130 is rotated, the tips of the flaps 134 engage the peaks of the ribbed filter material 62 thereby vibrating the filter material and effectively loosening dirt and debris from the pores thereof. While the vibration provides good cleaning action when utilized alone, it is particularly effective when utilized with the pneumatic cleaning mechanism previously described in this document.

In an alternative arrangement also illustrated in FIG. 7, the drive motor is connected to the filter 52 (note dash line in drawing FIG. 7). In this arrangement the filter 52 is rotated while the clicker 130 and lid section 38 remain stationary. The result is the same in that the tips of the flaps 134 engage the peaks of the ribbed filter media 62 as the filter is rotated thereby vibrating the media and loosening dirt and debris therefrom.

FIGS. 8*a*-8*d* schematically illustrate four possible alternative embodiments of a solenoid driven clicker arrangement for cleaning dirt and debris from a filter. In FIG. 8*a* a solenoid 150 is provided for driving a clicker 152. More specifically, the clicker 152 may take the form of a bumper. The solenoid 150 is utilized to drive the clicker 152 back and forth in the direction of action arrow G into and out of engagement with the side of the filter 154. This serves to vibrate the filter 154 thereby loosening and cleaning dirt and debris therefrom.

In FIG. 8*b* a solenoid 160 is connected directly to the frame of the filter 162. The solenoid is utilized to drive the filter 162 back and forth as indicated by direction arrow H so that the opposite side of the filter is brought into and out of engagement with a stationary clicker or bumper 164 mounted to a housing 166 of, for example, the dirt cup. The contact between the filter 162 and the clicker 164 creates vibration that loosens dirt and debris and cleans the filter.

FIG. 8*c* shows yet another possible embodiment wherein the clicker 170 is fixed to the wall of the dirt cup. The clicker 170 includes multiple resilient lugs 172 that engage the filter media 62 that extends between the hub 56 and outer side wall 54 of the filter 52. As illustrated, the filter 52 also carries a pinion 174 fixed to the hub 56. A solenoid 176 is connected to a rack 178 that meshes with the pinion 174. The solenoid 176 functions to displace the rack 178 back and forth in the direction of action arrow I thereby causing the pinion 174 and the filter 52 affixed thereto to rotate back and forth. As this occurs the lugs 172 engage the media 62 of the filter 52 thereby vibrating the filter material and effectively loosening dirt and debris from the pores thereof.

FIG. 8*d* discloses yet another embodiment. In this embodiment a rotary clicker 180 is provided. The rotary clicker 180 includes two depending, resilient lugs 182 and a pinion 184. The lugs 182 engage the filter media 62 that is stretched between the hub 56 and outer side wall 54 of the filter 52. A solenoid 186 is connected to a displaceable rack 188 that meshes with the pinion 184. The solenoid 186 functions to displace the rack 188 back and forth as illustrated by action arrow J. Since the rack 188 meshes with the pinion 184 this causes the clicker 180 to rotate back and forth with respect to the filter 52. As the clicker 180 is rotated, the lugs 182 engage the peaks of the ribbed filter material 62 thereby vibrating the filter material and effectively loosening dirt and debris from the pores thereof.

The foregoing description of preferred embodiments of the present invention has been presented for purposes of illustration and description. It is not intended to be exhaustive or to limit the invention to the precise form disclosed. Obvious modifications or variations are possible in light of the above teachings.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A floor cleaning apparatus, comprising:

a housing;

a suction generator carried on said housing;

a dirt collection vessel carried on said housing;

a filter carried on said dirt collection vessel;

a rotary clicker engaging said filter, said rotary clicker including a pinion, a body and at least one resilient lug; and a solenoid for driving said rotary clicker and cleaning said filter.

2. The floor cleaning apparatus of claim 1, further including a rack attached to said solenoid and engaged with said pinion.

3. The floor cleaning apparatus of claim 1, wherein said housing includes a nozzle assembly and a canister assembly.

4. The floor cleaning apparatus of claim 3, wherein said nozzle assembly and said canister assembly are pivotably connected together.

5. A floor cleaning apparatus, comprising:

a housing;

a suction generator carried on said housing;

a dirt collection vessel carried on said housing;

a filter carried on said dirt collection vessel, said filter carrying a pinion;

a clicker engaging said filter; and a solenoid for moving said filter with respect to said clicker to thereby vibrate dirt and debris from said filter, said solenoid being connected to a rack that meshes with said pinion.

6. The floor cleaning apparatus of claim 5, wherein said housing includes a nozzle assembly and a canister assembly.

7. The floor cleaning apparatus of claim 6, wherein said nozzle assembly and said canister assembly are pivotably connected together.

* * * * *